United States Patent [19]

Hendricks et al.

[11] Patent Number: 4,828,426

[45] Date of Patent: May 9, 1989

[54] DEVICE FOR IMPRINTING SURFACE OF FRESH CONCRETE

[76] Inventors: Lambert Hendricks, R.R. No. 1, Vars, Ontario, Canada, K0A 3H0; Angelo Gil, 9 Birchwood Avenue, Nepean, Ontario, Canada, K2E 5F7; Robert J. LeClair, 182-C Woodridge Cres., Nepean, Ontario, Canada, K2B 7S9

[21] Appl. No.: 152,828

[22] Filed: Feb. 5, 1988

[51] Int. Cl.[4] ..... E01C 23/02

[52] U.S. Cl. ..... 404/93; 404/89; 425/458

[58] Field of Search ..... 404/87, 89, 93, 97, 404/118–120, 75, 83; 249/15, 16; 425/385, 456, 458

[56] References Cited

U.S. PATENT DOCUMENTS

| | | | |
|---|---|---|---|
| 1,063,752 | 6/1913 | Walling | 404/93 |
| 1,560,734 | 11/1925 | Rook | 404/133 |
| 2,928,321 | 3/1960 | Kadlec | 404/133 |
| 3,406,618 | 10/1968 | Bowman | 404/83 X |
| 3,497,261 | 2/1970 | Schares | 404/87 X |
| 3,807,888 | 4/1974 | Bowman | 404/93 |
| 4,105,354 | 8/1978 | Bowman | 404/89 X |
| 4,131,406 | 12/1978 | Fresquez | 404/93 X |
| 4,135,840 | 1/1979 | Puccini et al. | 404/93 |
| 4,231,677 | 11/1980 | Roming | 404/89 |

FOREIGN PATENT DOCUMENTS

| | | | |
|---|---|---|---|
| 232941 | 2/1986 | German Democratic Rep. | 404/93 |
| 2176826 | 1/1987 | United Kingdom | 404/93 |
| 2193989 | 2/1988 | United Kingdom | 404/93 |

*Primary Examiner*—Stephen J. Novosad
*Assistant Examiner*—John F. Letchford
*Attorney, Agent, or Firm*—Burke-Robertson

[57] ABSTRACT

A device for manually, repetitively imprinting a surface pattern in fresh concrete, comprising: a plurality of blades secured together to form an imprinting unit, lower edges thereof to form the desired pattern when pressed into the levelled surface of fresh concrete; bar handle means to be secured transversely to upper portions of the blades and to extend laterally beyond the perimeter of the imprinting unit to facilitate manual operation of the device; and levelling means secured to and cooperating with the handle means for adjustably vertically positioning the blades of the device with respect to the surface to be imprinted. This device is practical for multiple, fast, repetitive impressions of patterns, in aligned, regular fashion, for example to form linearly and laterally aligned patterns in the surfaces of sidewalks or driveways.

21 Claims, 3 Drawing Sheets

DEVICE FOR IMPRINTING SURFACE OF FRESH CONCRETE

BACKGROUND OF THE INVENTION

The present invention relates to a device for manually repetitively imprinting a pattern, such a that of paving bricks, in the surface of fresh concrete for example for a sidewalk, driveway or the like.

To build a sidewalk or roadway out of cobblestones, paving stones and the like these days is a very expensive endeavour, because of the high cost of materials and high labour costs. Consequently, asphalt or concrete as usually used in such constructions, thereby foregoing the attractive appearance of such a sidewalk or roadway which cobblestones or bricks would provide.

Devices have been previously developed for imprinting a surface pattern on fresh concrete or the like. This presents no difficulties when, for example, the concrete is held in a mould for example for forming patio slabs (see e.g. Canadian Pat. No. 1,107,484 of Fontana et al issued Aug. 25, 1981).

U.S. Pat. Nos. 4,135,840 of Puccini et al issued Jan. 23, 1979; 3,807,888 of Bowman issued Apr. 30, 1974; and 3,406,618 of Bowman issued Oct. 22, 1968; and Canadian Pat. No. 1,133,273 of Roming issued Oct. 12, 1982 describe and illustrate imprinting tools comprising blades forming a particular pattern, to be pressed into the surface of fresh concrete. Some of these devices, such as that of Bowman, are tools on which a worker walks to press the pattern in. None of these tools is designed for high speed multiple imprinting of patterns along linear stretches of concrete. Nor are such devices practical for large scale commercial applications requiring multiple, fast, repetitive impressions of patterns, in aligned, regular fashion, for example to form linearly and laterally aligned patterns in the surfaces of sidewalks or driveways.

It is an object of the present invention to provide a manually operable device for forming repetitive, imprinted surface patterns in fresh concrete which device is practical for large scale commercial applications.

SUMMARY OF THE INVENTION

In accordance with the present invention there is provided such a device for manually, repetitively imprinting a surface pattern in fresh concrete. A plurality of blades are secured together to form an imprinting unit, the lower edges thereof to form the desired pattern when pressed into the levelled surface of fresh concrete. Bar handle means are secured to the upper portions of the blades so as to permit lifting of the device after imprinting and its transportation to an adjacent position for further imprinting. They extend laterally beyond the perimeter of the imprinting unit to facilitate manual operation of the device. Levelling means are secured to and cooperate with the handle means for adjustable vertical positioning of the blades of the device with respect to the surface to be imprinted.

In a preferred embodiment of the present invention the bar handle means comprises a pair of spaced parallel bars having sleeves secured to upper portions of the imprinting unit for slidably receiving the bars therewithin. Lock means are associated with the sleeve means to secure the sleeve means and imprinting unit in position as desired on the bars. A pair of such imprinting units are mounted on the bars The device according to the present invention is particularly practical for imprinting a surface pattern in an elongated strip of concrete poured between parallel forms, delimiting the lateral edges of the concrete, for example, in the construction of a sidewalk. For such applications, the device preferably has an alignment means downwardly depending from the handle means and slidably adjustable thereon to abut against one of the forms and maintain lateral alignment of the imprinting unit in the longitudinal direction.

If the surface pattern is of paving bricks or cobblestones, and the concrete is dyed an appropriate colour, a realistic, economical simulation of real paving stones or cobblestones may be achieved. The device in accordance with the present invention may be used, for example by a pair of workers handling the device from each side of the forms of a sidewalk, to provide a fast and efficient method of imprinting, in aligned fashion, the pattern from the imprinting unit or units along the sidewalk, after fresh concrete has been poured and levelled between the forms.

BRIEF DESCRIPTION OF THE DRAWINGS

These and other objects and advantages of the invention will become apparent upon reading the following detailed description and upon referring to the drawings in which.

Figure 1:
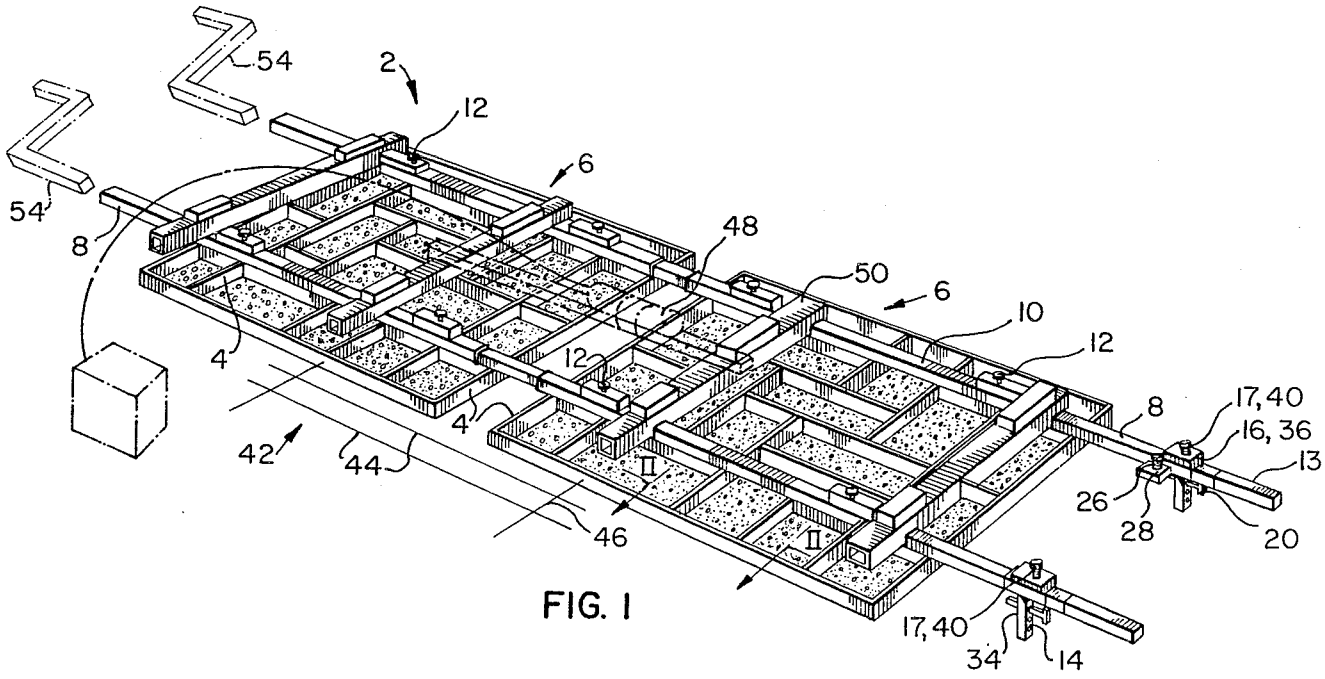
FIG. 1 is a perspective view of a concrete imprinting device in accordance with the present invention.

While the invention will be described in conjunction with example embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

In the drawings similar features have been given similar reference numerals.

Figure 2:
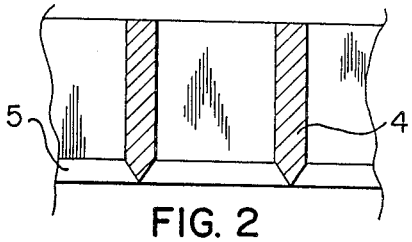
FIG. 2 is a partial section view of a portion of the device of FIG. 1 along lines II—II.

Turning to FIG. 1 there is illustrated an impression device 2 in accordance with the present invention for manually repetitively imprinting a surface pattern in fresh concrete. The device comprises a plurality of blades 4 secured together in vertical orientation, with their blade edges downwardly oriented and preferably terminating in the same plane (FIG. 2). As can be seen in FIG. 2, the lower edges 5 of the blades are V-shaped to assist in formation of the desired pattern. The V, for example, may have an angle of 60°. It is preferred that at least that portion of the blade which is to be impressed into fresh concrete be coated with, for example, a paint to minimize the sticking of concrete to the blades and create a more even pattern. The blades are preferably made of a metal such as aluminum. These blades form, together, an imprinting unit 6 which will leave the desired pattern (a brick pattern forming squares in the illustrated embodiment) when pressed into fresh concrete. A pair of such imprinting units 6 are slidably mounted, in the embodiment of FIG. 1, on bars 8 by means of sleeves 10, through which sleeves are threadably secured appropriate locking bolts 12. With locking bolts 12 loosened, imprinting units 6 may be moved to appropriate positions, relative to each other, on bars 8, and then secured on the bars in such positions by tightening lock bolts 12. Bars 8, and corresponding sleeves 10, are aligned parallel to each other. The ends 13 of bars 8 preferably extend outwardly beyond the corresponding lateral perimeter of the adjacent imprinting unit 6, each pair of ends on each side thereby easily handled by an operator.

Figure 3:
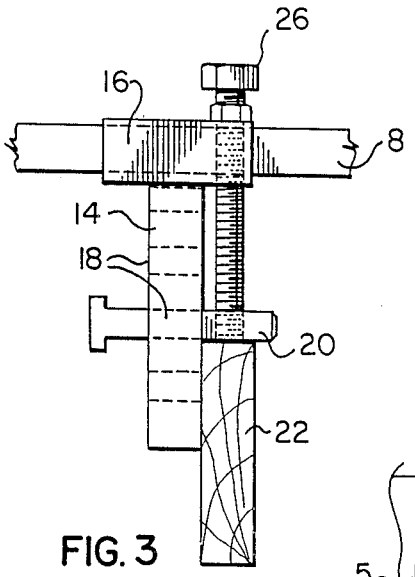
FIG. 3 is an enlarged perspective view of a vertical adjustment means for the device of FIG. 1.

To the device 2, preferably downwardly depending from bars 8 are means for vertically adjusting the height of device 2 with respect to the surface of concrete, and hence the depth of impression made by blades 4 in the concrete surface. These adjustment means may be in the form of vertical adjustment foot means or bars 14. These bars are slidably mounted on bars 8 by means of sleeves 16 and may be secured in a particular position on bar 8 by means of threaded lock bolt 17. A plurality of holes 18 are vertically aligned within each of the bars 14, to removably receive a bolt 20. By placing bolts 20 in predetermined holes 18 on bars 14 at the end of each of arms 8, and resting these bolts on the upper edge of forms 22 on either side of parallel forms 22 between which fresh concrete 24 has been poured (FIG. 5), the depth of impression of blades 4 in the upper surface of cement 24 may be appropriately varied. Alternatively and preferably, to adjust the depth of the impression, bolts 26 (FIGS. 1, 3) threaded through flanges 28 in or portions of sleeves 16 slidably mounted on the ends of bars 8 may be positioned so that their ends rest on the upper edges of forms 22 to provide the proper depth of impression of units 6 inn cement 30.

Also slidably securable on the ends of bars 8 are cooperating pairs of alignment means 34, these alignment means being bars vertically downwardly extending from sleeves 36 slidably mounted on bars 8 and lockable in position by means of lock bolts 40 threaded through sleeves 36 to bear against bars 8. By aligning corresponding pairs of bars 36, and ensuring that bars 38 bear against the corresponding outer edge of a form 22 beside a sidewalk with the fresh concrete to be imprinted, alignment of the impressions formed by imprinting units 6 in the longitudinal direction of the sidewalk can be ensured. In the illustrated embodiment, adjustment bars 14 double as alignment means 34.

To assist in appropriate spacing of the impressions formed by imprinting units 6 in placing consecutive impressions linearly along the surface of cement 30 in the direction of the sidewalk, a linear spacing means 42 consisting of one or more wires 44 mounted on outwardly extending rods 46, which rods are removably mounted on the sides of outer blades 4. Wires 44 are positioned normal to the line formed by aligned bars 34, are provided. In this manner, in the illustrated embodiment, the wires 44 are positioned with respect to the adjacent edge of imprinting units 6, so that when the wires are lined up, for example with an expansion joint or line of a previously made impression in an adjacent space extending transversely across the sidewalk being built, the units 6 will be properly positioned (in the longitudinal direction) with respect to such joints or adjacent impressions previously made for the next impression. Each wire 44 may be used for alignment with specific, different transverse lines in the sidewalk being imprinted.

It has been found that the impression left by units 6, in some instances, may be too rounded, for example for elderly persons walking on the sidewalk surface or for wheelchairs. In this instance, by mounting a vibrator 48 on the top of the device 2, vibrations thereby generated create a sharper, less rounded impression, and hence smoother upper surface which facilitates the passage of wheelchairs and the like over such surface.

Figure 4:
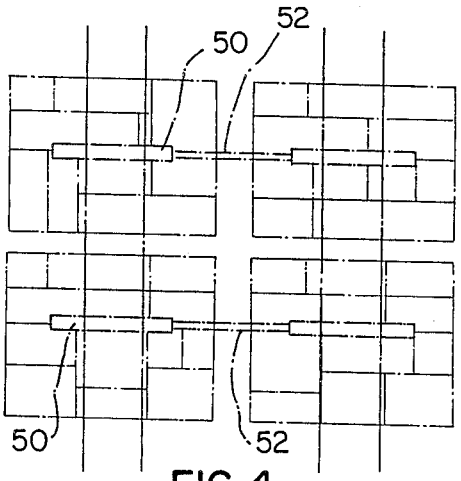
FIG. 4 is a schematic view of an alternative embodiment of the device of FIG. 1, intended for multiple impressions over larger areas.

In the alternative embodiment illustrated in FIG. 4, a further set of sleeves 50 are mounted, normal to the first set of sleeves 10, these sleeves 50 to receive bars 52 which in turn support a similar pair of imprinting units 6 mounted as illustrated in FIG. 1. This enables two pairs of units 2 to be assembled, in square fashion, to be used at once, each of the pairs of units being adjustable, with respect to each other, by sliding sleeves 50 upon bars 52. Indeed, it will be understood that imprinting device having more than two imprinting units transversely aligned, or more than two pairs of such units linearly aligned (with respect to the longitudinal direction of the sidewalk in question) may be formed by suitable, corresponding modifications to the sleeve and bar structure supporting the units.

Bars having offset handles 54 (phantom FIG. 1) may be used as required, for example, where it is needed to avoid obstructions beside the forms 22 such as telephone poles, hydrants, etcetera.

Figure 5:
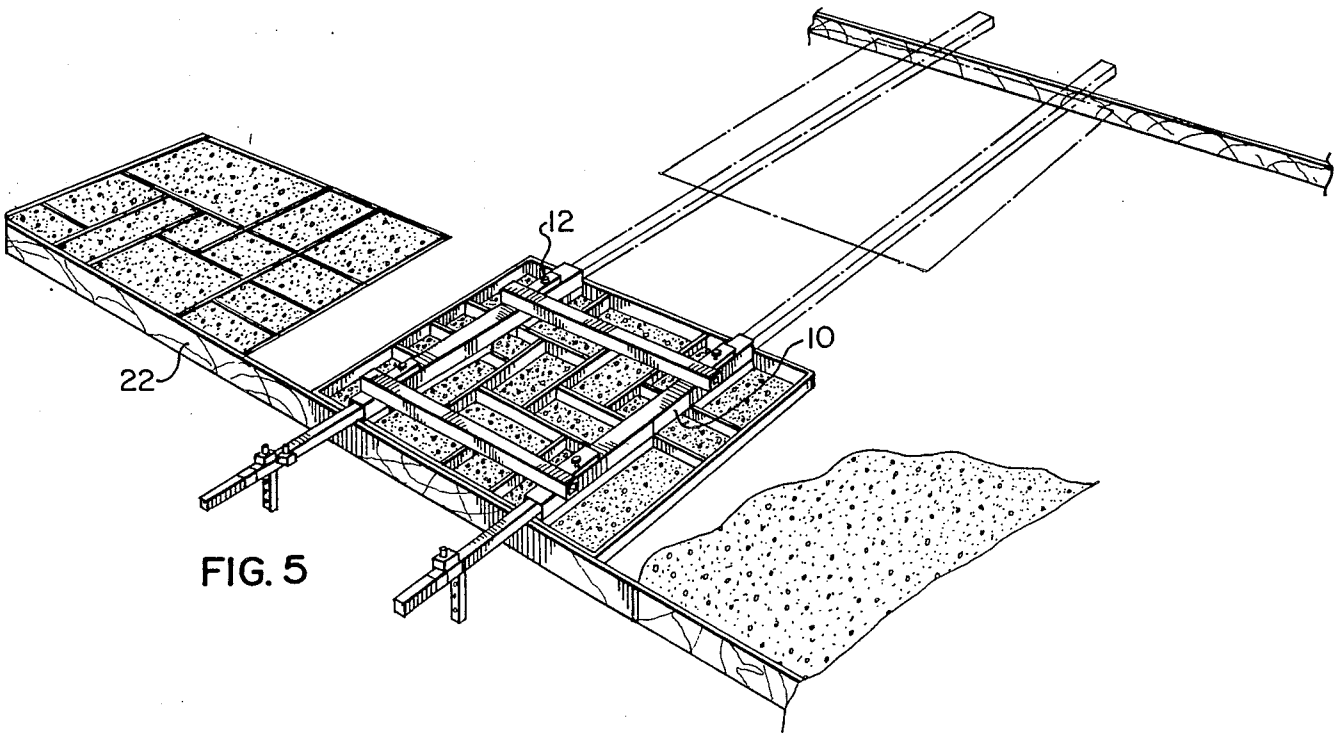
FIG. 5 is a schematic view of a section of sidewalk in which freshly poured, levelled concrete is being imprinted with a pattern using the device of FIG. 1.

In operation, as can be seen in FIG. 5, alignment bars 34 locked are appropriate corresponding lateral positions on at least one side of arms 8, so that they are aligned in the linear direction of the sidewalk to be imprinted. Units 6 are appropriately laterally positioned on arms 8 and locked in such position by means of lock bolts 12. An appropriate impression depth is ascertained by placing bolts 20 in appropriate holes 18 (or providing bolts 26 in flanges 28 with the appropriate depth), so that bolts 20 (or the ends of bolts 26), when resting on the tops of forms 22 with arms 8 extending transversely across the sidewalk to be imprinted. The device is now ready to provide repetitive imprinting of the pattern provided by blades 4 in the surface of fresh concrete which has been levelled.

The operators, one on either side of the device, merely lift the device vertically so that the blades clear the levelled concrete surface after each impression, and move the device longitudinally along the forms to the next linearly adjacent location of concrete 24. By pressing the aligned bars 24 against the outer surface of forms 22, the same lateral alignment of imprinting units 6 is achieved. By appropriate alignment of wire 44 with a joint or the like in the transverse direction, an appropriate desired regular linear alignment of unit 6 may be achieved.

While the device according to the present invention has been described in particular in conjunction with the construction of a sidewalk, similar principles would apply in the construction of, for example, a driveway or a roadway surface with the desired pattern imprinted therein.

Thus it is apparent that there has been provided in accordance with the invention a device for manually repetitively imprinting a surface pattern that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

The embodiments of the invention in which an exclusive property or privilege is claimed are defined as follows:

1. A device for manually, repetitively imprinting a surface pattern in fresh concrete, comprising:

(a) a plurality of blades secured together to form an imprinting unit, lower edges thereof to form the desired pattern when pressed into the levelled surface of fresh concrete;

(b) bar handle mans secured to upper portions of the blades so as to permit lifting of the device after imprinting and transporting the device to an adjacent position for imprinting, the bar handle means extending laterally beyond opposite perimeters of the imprinting unit; and (c) levelling means secured to and cooperating with the handle means secured to and cooperating with the handle means for adjustably vertically positioning the blades of the device with respect to the surface to be imprinted.

2. A device according to claim 1 wherein the blade means are coated with paint to minimize the adhering of fresh cement thereto during operation of the device.

3. A device according to claim 1 wherein the lower edges of the blades terminate in the same plane.

4. A device according to claim 1 wherein the levelling means comprises vertically adjustable foot means downwardly extending from the handle means.

5. A device according to claim 1 wherein a vibrator means is mechanically associated with the device to vibrate the imprinting unit during operation of the device to sharpen the imprint formed by the device and leave a more even surface.

6. A device according to claim 1 wherein means are provided for adjusting the lateral positioning of the imprinting unit on the bar handle means.

7. A device according to claim 6 wherein a pair of imprinting units are mounted for relative lateral positioning on the bar handle means.

8. A device according to claim 6 further comprising supplementary bar handle means to be secured to the device above the upper portions of the blades to extend normal to the transversely extending bar handle means, an imprinting unit being slidably supported on said supplementary bar handle means so that the lower edges of the blades of the imprinting units are in the same plane, and the supplementary bar handle means extending laterally beyond the perimeters of the imprinting units to facilitate manual operation of the device.

9. A device according to claim 1 for imprinting a surface pattern in an elongated strip of levelled concrete which has been poured between parallel forms delimiting the lateral edges of the concrete, further comprising laterally adjustable alignment means downwardly depending from the handle means to abut against the side of one of the forms and maintain lateral alignment of the imprinting unit in the longitudinal direction.

10. A device according to claim 9 further comprising linear spacing means secured to the device to permit spacing of the imprinting unit in the longitudinal direction.

11. A device according to claim 10 wherein the linear spacing means comprise a wire positioned beyond the perimeter of the unit, the wire extending in the lateral direction.

12. A device according to claim 1 wherein the bar handle means comprises a pair of spaced parallel bars.

13. A device according to claim 12 wherein means are provided for adjusting the lateral positioning of the imprinting unit on the bar handle means.

14. A device according to claim 13 wherein sleeves are secured to upper portions of the imprinting unit for slidably receiving the bars within, and lock means are associated with the sleeve means to secure the sleeves and imprinting units in position as desired on the bars.

15. A device according to claim 14 wherein a pair of imprinting units are mounted for sliding lateral positioning on the bars.

16. A device according to claim 15 wherein the levelling means comprises vertically adjustable foot means downwardly extending from the bars.

17. A device according to claim 15 wherein a first pair of imprinting units are mounted for slidable lateral positioning on a first pair of spaced parallel bars, and a second pair of imprinting units are mounted for slidable lateral positioning on a second pair of spaced parallel bars, and the first and second pair of imprinting units are mounted for relative longitudinal positioning on spaced parallel bars to which the two pairs of imprinting units are slidably mounted.

18. A device according to claim 13 for imprinting a surface pattern in an elongated strip of levelled concrete which has been poured between parallel forms delimiting the lateral edges of the concrete, further comprising laterally adjustable alignment means downwardly depending from the handle means to abut against the side of one of the forms and maintain lateral alignment of the imprinting unit in the longitudinal direction.

19. A device according to claim 18 wherein sleeves are secured to upper portions of the imprinting unit for slidably receiving the bars within, and lock means are associated with the sleeve means to secure the sleeves and imprinting unit in position as desired on the bars.

20. A device according to claim 19 wherein wherein a pair of imprinting units are mounted for sliding lateral positioning on the arms.

21. A device according to claim 20 wherein the levelling means comprises vertically adjustable foot means downwardly extending from the handle means.

* * * * *

UNITED STATES PATENT AND TRADEMARK OFFICE

CERTIFICATE OF CORRECTION

PATENT NO. : 4,828,426

DATED : May 9, 1989

INVENTOR(S) : Lambert Hendriks, et al.

It is certified that error appears in the above-identified patent and that said Letters Patent is hereby corrected as shown below:

ON THE TITLE PAGE:

Inventor's name "Lambert Hendricks" should be amended to read "Lambert Hendriks"

Item, [19], "Hendricks et al." should read -- Hendriks et al. --.

Signed and Sealed this

Sixteenth Day of January, 1990

*Attest:*

JEFFREY M. SAMUELS

*Attesting Officer*

*Acting Commissioner of Patents and Trademarks*